United States Patent [19]

Focke et al.

[11] Patent Number: 4,907,608

[45] Date of Patent: Mar. 13, 1990

[54] PROCESS AND APPARATUS FOR TESTING CIGARETTES

[75] Inventors: Heinz Focke; Kurt Liedtke, both of Verden, Fed. Rep. of Germany

[73] Assignee: Focke & Co., Verden, Fed. Rep. of Germany

[21] Appl. No.: 37,272

[22] Filed: Apr. 10, 1987

[30] Foreign Application Priority Data

Apr. 18, 1986 [DE] Fed. Rep. of Germany ..... 3613090

[51] Int. Cl.[4] ..... B07C 5/34; B65B 19/30

[52] U.S. Cl. ..... 131/282; 209/535

[58] Field of Search ..... 131/907, 282, 283; 209/535, 536, 537

[56] References Cited

U.S. PATENT DOCUMENTS 4,667,831 5/1987 Mattei et al. ..... 131/907

FOREIGN PATENT DOCUMENTS

| | | |
|---|---|---|
| 0086107 | 2/1983 | European Pat. Off. . |
| 0100537 | 7/1983 | European Pat. Off. . |
| 2757881 | 6/1971 | Fed. Rep. of Germany . |
| 2638476 | 3/1977 | Fed. Rep. of Germany . |
| 2713662 | 11/1978 | Fed. Rep. of Germany . |
| 2829326 | 8/1979 | Fed. Rep. of Germany . |
| 3304299 | 9/1983 | Fed. Rep. of Germany . |
| 2150807 | 7/1985 | United Kingdom . |

*Primary Examiner*—V. Millin

*Attorney, Agent, or Firm*—Sughrue, Mion, Zinn, Macpeak & Seas

[57] ABSTRACT

In order to separate out defective cigarettes (29) in an economical way, cigarettes are tested in the region of magazine shafts (11*a*, 11*b*, etc.; 12*a*, 12*b*, etc.) of a cigarette magazine (10). The defective cigarettes (29) identified are conveyed beyond a lower main pushing-out plane (22) and are separated out below this. For this purpose, supporting members (carrying webs 32) for the cigarettes are movable up and down at the bottom end of the magazine shafts.

9 Claims, 4 Drawing Sheets

PROCESS AND APPARATUS FOR TESTING CIGARETTES

BACKGROUND OF THE INVENTION

The invention relates to a process for testing cigarettes and separating out defective cigarettes, the test being carried out in the region of magazine shafts of a cigarette magazine by a test unit which can be advanced to the ends of the cigarettes, and defective cigarettes being separated out in succession, whereas intact cigarettes are pushed out in groups (cigarette groups) at the bottom end of the magazine shafts (main pushing-out plane).

The necessary testing of cigarettes to ensure that they are correctly formed is carried out in conjunction with the packaging operation. The test is conducted by suitable mechanical or optoelectronic test units. Hitherto, these have mainly been used in a region in which cigarette groups are already formed for packaging within a packaging machine. Any defective cigarettes detected means that the entire cigarette group has to be separated out.

SUMMARY OF THE INVENTION

The invention relates to the testing of cigarettes in the region of the magazine shafts of cigarette magazine. The object on which the invention is based is to make it possible to separate out individual defective cigarettes, without impairing the feed flow of cigarettes and the formation of cigarette groups in the outlet region of the cigarette magazine.

To achieve this object, the process according to the invention is characterized in that defective cigarettes are conveyed beyond the main pushing-out plane for the cigarette groups into a region below this and are separated out here.

According to the invention, the defective cigarettes are therefore identified at a suitable point in the region of the magazine shafts, but are then first conveyed further together with the intact cigarettes and are separated out below the region where the cigarette groups are pushed out for packaging. Within the magazine shafts, the cigarettes are conveyed in stages, in particular corresponding to the number of layers of a cigarette group pushed out. When the cigarette groups have a conventional composition, these conveying stages each correspond to three cigarettes. According to the invention, influence is brought to bear on the conveying stages of the cigarettes in the magazine shafts after each cigarette group has been pushed out. By varying the position of the support for the cigarettes at the bottom end of the magazine shafts, it is possible to make the cigarettes fall down in an amount which differs from the predetermined conveying stage corresponding to three cigarettes, in particular one corresponding to four cigarettes, the bottom cigarette of the cigarettes conveyed after them passing into the region below the main pushing-out plane. According to the invention, the conveying steps are influenced in this way individually for each single magazine shaft, depending on the detection of any defective cigarettes in a magazine shaft. The cigarettes are tested at a sufficient predetermined distance from the main pushing-out plane, specifically as a cigarette group subsequently to be pushed out. If defective cigarettes are identified in any one of the (vertical) cigarette rows delimited by the magazine shafts, then, depending upon the position of the defective cigarette within the cigarette group, the conveying steps for the cigarettes within this row or within this magazine shaft are fixed accordingly, in such a way that the defective cigarette finally passes into the region below the main pushing-out plane and can be pushed out here.

The apparatus according to the invention is equipped with individually movable supporting members underneath each magazine shaft. By relative adjustment of the supporting members, in particular by moving them downwards an amount corresponding to the diameter of one cigarette, it is possible to convey (defective) cigarettes into the region below the main pushing-out plane. Moreover, the apparatus is designed so that a supplementary or checking test of the cigarettes is carried out after the formation of the cigarette groups. The number of defective cigarettes occurring under these conditions is drastically reduced as a result of the process according to the invention.

Further features of the invention relate to the design of the cigarette magazine and to the members for carrying out the cigarette test according to the invention.

The process according to the invention and an exemplary embodiment of the apparatus are explained in detail below with reference to the drawings, In these:

DESCRIPTION OF PREFERRED EMBODIMENTS

Figure 1:
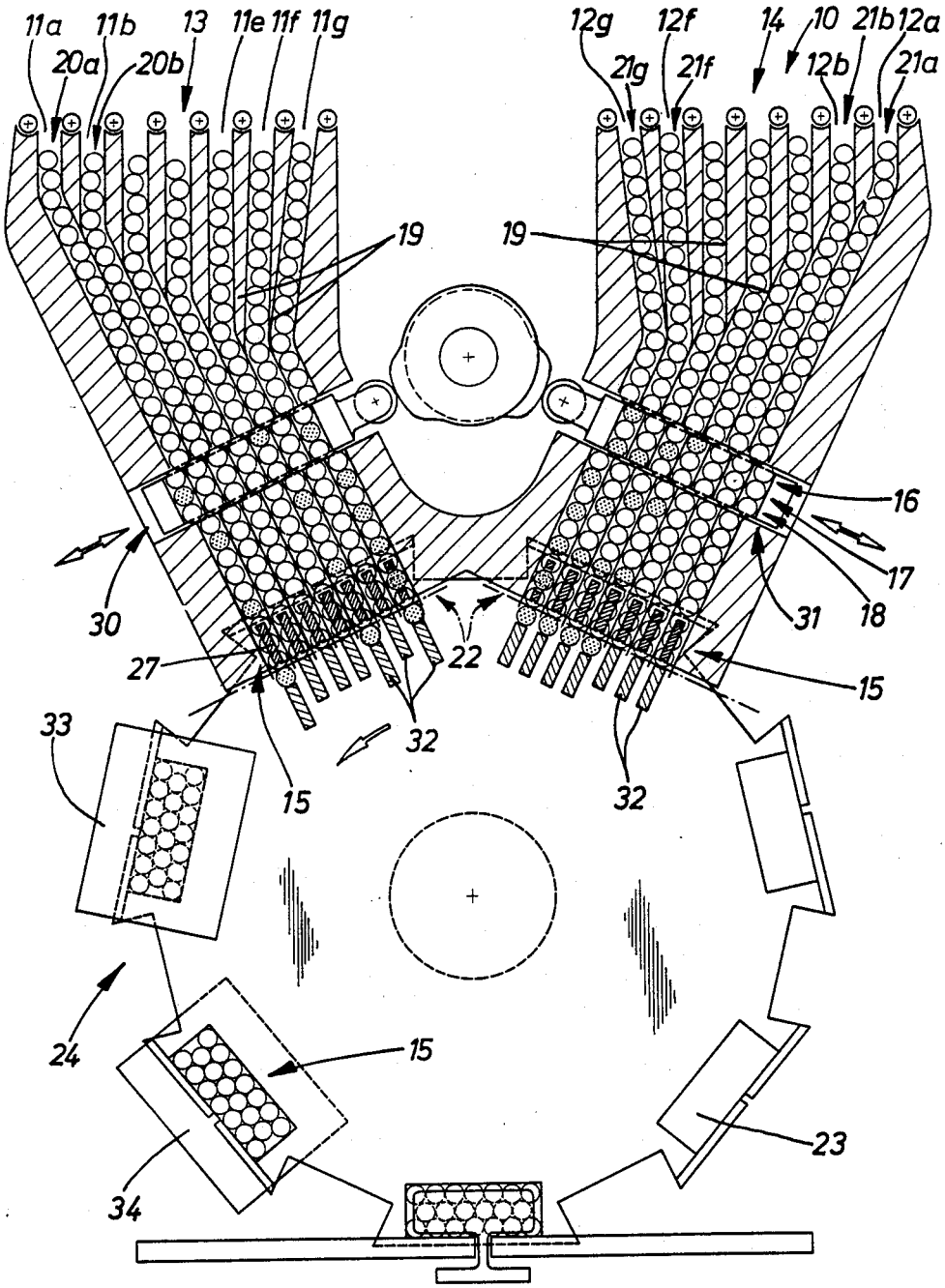
FIG. 1 shows, in vertical section, a cigarette magazine with a cigarette turret.

FIG. 1 shows the bottom part of a cigarette magazine 10. This is conventionally used as a feed unit for introducing the cigarettes supplied into a cigarette packaging machine. The upper part, not shown here, is made funnel-shaped in the usual way. The cigarettes leave the cigarette magazine 10 at the bottom via magazine shafts 11*a*, 11*b*, etc., and 12*a*, 12*b*, etc. In the exemplary embodiment illustrated, two groups of magazine shafts 11*a*, 11*b*, etc., and 12*a*, 12*b*, etc., are combined into shaft groups 13, 14. Each shaft group 13, 14 comprises seven magazine shafts 11*a*, 11*b*, etc., and 12*a*, 12*b*, etc. This number of magazine shafts matches the number of cigarettes per cigarette group 15 for a cigarette pack. The cigarette group 15 here comprises three layers 16, 17, 18, the outer or upper and lower layers 16 and 18 each comprising seven cigarettes, and the middle layer 17 six cigarettes.

Within the shaft groups 13, 14, the agazine shafts 11*a*, 11*b*, etc., and 12*a*, 12*b*, etc., are separated from one another by thin shaft walls 19. The shaft walls 19 are inclined, in particular converging, in the lower region of the shaft groups 13, 14, so that cigarettes rows 20*a*, 20*b*, etc., and 21*a*, 21*b*, etc., formed in the magazine shafts 11*a*, 11*b*, etc., and 12*a*, 12*b*, etc., are also inclined.

Figure 3:
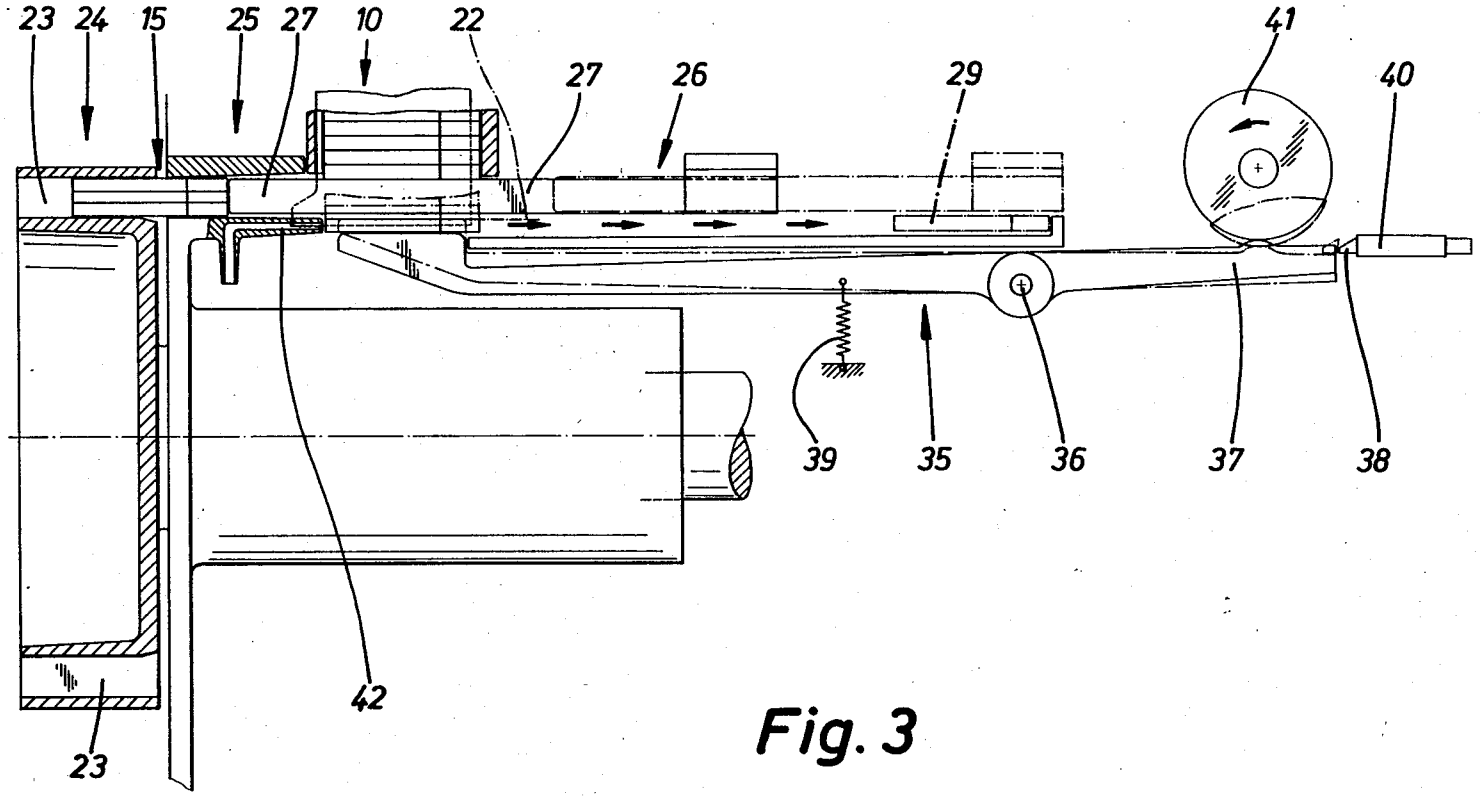
FIG. 3 shows the bottom part of the cigarette magazine in a cross-section offset 90° relative to FIGS. 1 and 2.

The magazine shafts 11*a*, 11*b*, etc., and 12*a*, 12*b*, etc., and consequently the cigarette rows 20*a*, 20*b*, etc., and 21*a*, 21*b*, *etc.*, end in the region of a main pushing-out plane 22. Here, cigarette groups 15 are pushed out of the respective shaft groups 13 and 14 in the longitudinal direction of the cigarettes. The layers 16, 17 and 18 are formed at the same time, so that the middle layer 17 consisting of six cigarettes is offset (the so-called saddle position) relative to the cigarettes of the outer layers 16 and 18. The cigarette group enters a pocket 23 of a cigarette turret 24 arranged offset relative to the shaft groups 13, 14. This, rotating in a vertical plane, is arranged relative to the cigarette magazine 10, in such a way that particular pockets 23 located at the top are directed obliquely towards one another, in particular in a roof-like manner, and are aligned with the main pushing-out plane 22 of the two shaft groups 13 and 14. Each time, three cigarettes resting on top of one another are pushed out of the magazine shafts 11*a*, 11*b*, etc., and 12*a*, 12*b*, etc., in the region of the main pushing-out plane 22, in the longitudinal direction of the cigarettes, through a mouthpiece 25 (FIG. 3) adjacent to each of the shaft groups 13, 14 and into the aligned pocket 23 of the cigarette turret 24. The arrangement is such, here, that only two cigarettes resting on top of one another are pushed out of the inner magazine shafts 11*g* and 12*g* facing one another, in the main pushing-out plane 22, whilst the cigarette which is in the middle layer 17 and which is located in each of the magazine shafts 11*g* and 12*g* is retained. During the transport of the cigarette group 15 through the mouthpiece 25, the layers 16, 17, 18 are arranged in the form ready for packaging the cigarettes.

The cigarette group 15 is pushed out by a pushing-out member 26 (FIG. 3) which penetrates into the lower region of the magazine shafts 11*a*, 11*b*, etc., and 12*a*, 12*b*, etc., with a number of slide fingers 27 corresponding to the number of magazine shafts 11*a*, 11*b*, etc., and 12*a*, 12*b*, etc. The slide fingers 27 are of rectangular cross-section. The overall height is such that, each time, three cigarettes resting on top of one another are pushed out of each magazine shaft 11*a*, 11*b*, etc., and 12*a*, 12*b*, etc. The cigarettes are conveyed by the slide fingers 27 into the prepared pockets 23 of the cigarette turret 24.

Figure 2:
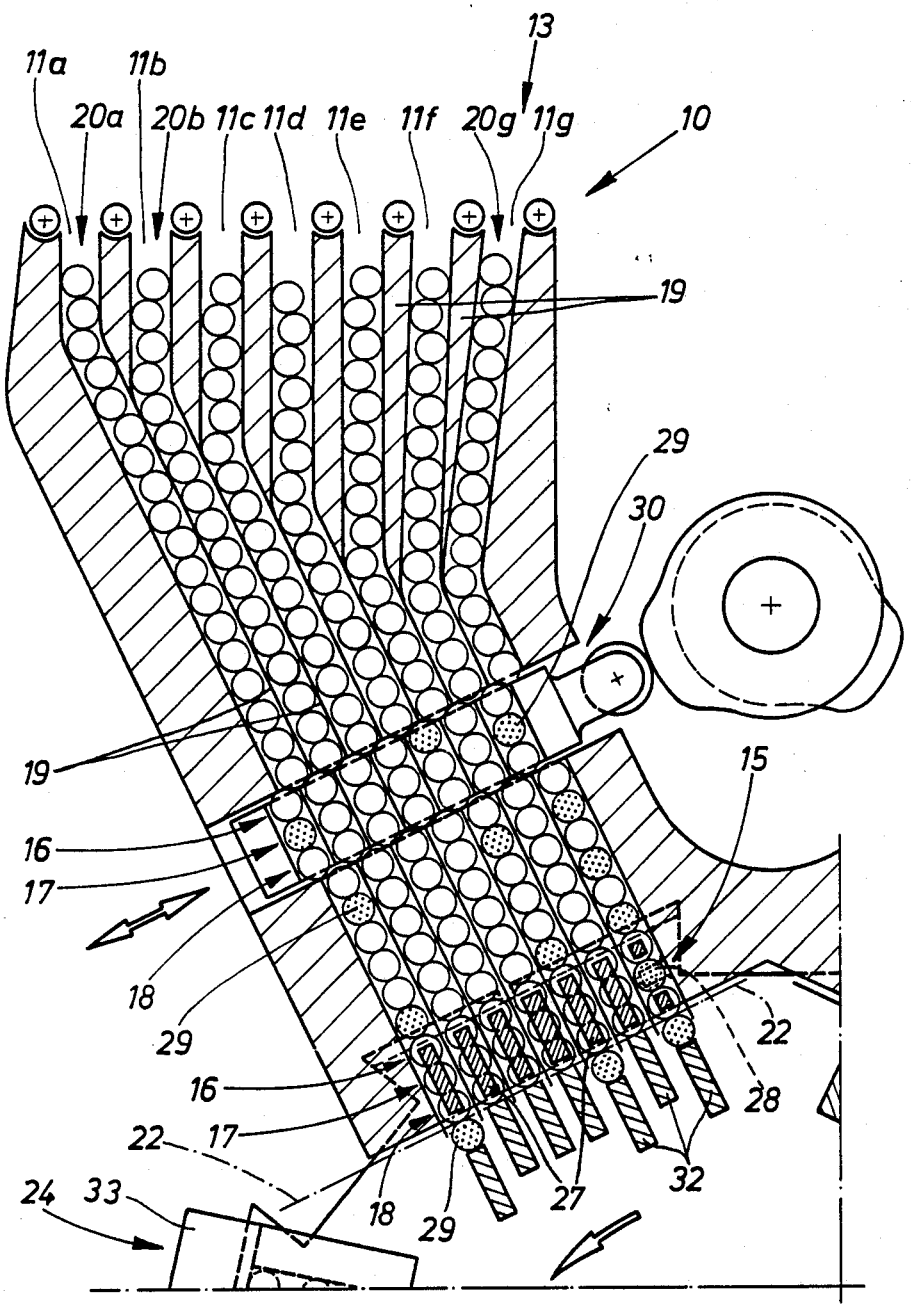
FIG. 2 shows a detail of the cigarette magazine according to FIG. 1 on an enlarged scale.

In the region of the inner magazine shafts 11*g* and 12*g*, a fixed boss (FIG. 2) 28 is located at the height of the middle layer 17 in the pushing-out region. This retains a cigarette of the middle layer 17 in the magazine shaft 11*g* and 12*g*, so that only two cigarettes are pushed out here. The corresponding slide finger 27 is provided with a central slot which makes it possible to push out the cigarettes above and below the boss 28.

The cigarettes are tested to ensure that they are correctly formed in the region of the shaft groups 13 and 14. Most defective cigarettes 29 by far are separated out here, that is to say are not pushed out as an integral part of a cigarette group 15. The cigarettes are tested in a region at a predetermined distance from the main pushing-out plane 22. In the exemplary embodiment illustrated, transverse slides 30, 31 are formed in the region of the shaft groups 13, 14. These are frame-like structures which act as part of the shaft groups 13, 14, in particular as extensions of the magazine shafts 11*a*, 11*b*, etc., and 12*a*, 12*b*, etc. The particular design and mode of operation of these transverse slides 30, 31 are the subject of German Patent Application P 36 02 428.7. The transverse slides 30, 31 take up a number of cigarettes corresponding to a cigarette group 15, specifically in three layers 16, 17, 18. These are jointly shifted transversely an amount corresponding to half the width of a magazine shaft 11*a*, 11*b*, etc., and 12*a*, 12*b*, etc., in such a way that the cigarettes within the transverse slides 30, 31 are aligned on the top ends of the lower parts of the shaft walls 19. In this shifted position, the cigarette group 15 located in the transverse slide 30 or 31 is tested, specifically by means of a suitable known test device (not shown in detail).

Any defective cigarettes 29 within the cigarette group of the transverse slide 30, 31 are identified by the test device, and control signals are derived from it.

After the transverse slide 30, 31 has returned from the test position (FIGS. 1 and 2) into the position aligned with the magazine shafts 11*a*, 11*b*, etc., and 12*a*, 12*b*, etc., the cigarettes are conveyed further downwards as a result of their own weight, after a cigarette group 15 has been pushed out in the main pushing-out plane 22 and the slide fingers 27 have returned to the initial position. The downward advance of the cigarettes in the individual magazine shafts 11*a*, 11*b*, etc., and 12*a*, 12*b*, etc., corresponds to three cigarettes. In the lower position, the cigarettes of the bottom layer 18 rest on carrying webs 32 which are assigned to each magazine shaft 11*a*, 11*b*, etc., and 12*a*, 12*b*, etc. Accordingly, each magazine shaft is closed off in the main pushing-out plane 22 by a carrying web of this type.

In the present case, the carrying webs 32 are movable, specifically lowerable relative to the initial or normal position in the main pushing-out plane 22. In the lowered position, the distance between the top side or supporting side of a carrying web 32 and the main pushing-out plane 22 corresponds approximately to the diameter of one cigarette. The conveying steps for the cigarettes in the particular magazine shaft 11*a*, 11*b*, etc., and 12*a*, 12*b*, etc., can be influenced by the controlled lowering of carrying webs 32, in particular can be increased to four cigarettes. It is thereby possible to convey defective cigarettes 29 past the pushing-out region and separate them out below the main pushing-out plane 22. For this purpose, when defective cigarettes 29 are detected in the region of the transverse slide 30, 31, the position of the defective cigarette in the layer 16, 17, or 18 determines which conveying steps must subsequently be executed within the magazine shaft 11*a*, 11*b*, etc., and 12*a*, 12*b*, etc., which has the defective cigarette 29. It is necessary to ensure that, before the last conveying cycle, the defective cigarette 29 has arrived above the cigarette group 15 ready to be pushed out. After the magazine shafts have been cleared in the pushing-out region, the carrying web 32 of the magazine shaft having the defective cigarette 29 is lowered, so that the cigarettes in this magazine shaft are subsequently conveyed further a stage corresponding to four cigarettes. As a result, the defective cigarette, resting on the lowered carrying web 32, passes into the region below the main pushing-out plane 29. After the defective cigarette 29 has been eliminated, the carrying web 32 returns to the initial or normal position.

The control of the respective carrying webs 32, so that the particular defective cigarettes 29 can be separated out in the way described above, is explained below by reference to the falling possibilities illustrated. A defective cigarette 29 in the middle layer 17 has been identified in the magazine shaft 11*a*. As is evident, as a result of a standard conveying cycle corresponding to three cigarettes, this defective cigarette passes into a position below the transverse slide 30. A conveying stage corresponding to four cigarettes is then executed, specifically by lowering the carrying web 32, assigned to the magazine shaft 11*a*, during the downward movement of the cigarettes. During this larger conveying cycle, an intact cigarette is lost as a result of the lowering of the carrying web 32. However, the defective cigarette 29 has assumed a position immediately above the cigarette group 15 to be pushed out. As a result of a further conveying cycle corresponding to four cigarettes, with the carrying web 32 lowered, the defective cigarette 29 is separated out. Accordingly, the outcome is that an intact cigarette has been "sacrificed" in order to separate out this defective cigarette 29 in the magazine 11*a*.

If the defective cigarette 29 is in the region of the top layer 16, shown by means of the magazine shaft 11*e*, two conveying steps, each corresponding to four cigarettes, are required, in order to convey the particular defective cigarette 29 into the position above the cigarette group 15 to be pushed out and then into the separating-out position below the main pushing-out plane 22. In this case, two intact cigarettes are therefore lost.

When the defective cigarette 29 is in the bottom layer 18 of the transverse slide, shown by means of the magazine shaft 12*f*, only two conveying steps, each corresponding to three cigarettes, are required, in order to move the defective cigarette 29 into the necessary position above the cigarette group 15 to be pushed out. A special situation arises as regards the magazine shafts 11*g* and 12*g*. Here, the boss 28 for retaining a cigarette of the middle layer 17 is located in the region of the particular cigarette group 15 to be pushed out. Accordingly, in these magazine shafts 11*g* , 12*g*, the cigarettes are moved further in conveying steps each corresponding to two cigarettes. Here, the carrying web 32, by being lowered, has to be involved in the conveying process if, for example, the defective cigarette has been identified in the middle layer 17 in the transverse slide 31. In contrast to this, if a defective cigarette 29 is in the top layer 16 or in the bottom layer 18, it reaches the position immediately above the cigarette group 15 to be pushed out, by means of the standard conveying steps corresponding to two cigarettes each, so that the carrying web 32 has to be lowered below the main pushing-out plane 22 only when the defective cigarettes 29 are separated out.

By means of the system described, defective cigarettes can be identified in a simple way in most cases by far and can be separated out without impairing the performance of the apparatus. Loss of intact cigarettes in particular instances bears no relation to the loss of intact cigarettes when a complete cigarette group 15 containing one defective cigarette is separated out.

As a precaution, a further cigarette test is carried out after the cigarette magazine 10 or the cigarette test in the region of the latter, specifically in the region of the cigarette turret 24. When the latter is at a stand-still, suitable known cigarette test units 33, 34 are moved up to the cigarette groups 15 in the pockets 23 in two successive positions, in order to identify any defective cigarettes which may be present. The cigarettes are tested in the region of the cigarette turret 24 on both sides of the cigarettes, so that any cigarette filters which may be missing are also detected.

The carrying webs 32 movable up and down can be designed and actuated in various ways. In the exemplary embodiments according to FIGS. 3 and 4, each carrying web 32 is the head of a pivotable actuating lever 35. Here, this is two-armed and is pivotable about a pivot bearing 36. When the carrying web 32 is raised (the normal position), a free lever arm 37 is in the position represented by broken lines. In this position, the setting of the actuating lever 35 together with the carrying web 32 is fixed by a pawl 38 which rests on the free end of the acuating lever 35. The actuating lever 35 is held in this position against the load of a spring (tension spring 39). The pawl 38 is retractable, in the present case by means of a flat pneumatic cylinder 40.

When a defective cigarette 29 is detected in one of the magazine shafts 11*a*, 11*b*, etc., and 12*a*, 12*b*, etc., the respective flat cylinder 40 is subjected to pressure and the pawl 38 is retracted, if conveying steps corresponding to more than three cigarettes are necessary in order to bring the defective cigarette into the desired position. When the pawl 38 is retracted, the lever arm 37 is pressed against a rotating control disc 41 which, as a result of its particular shape, controls the relative position of the actuating lever 35 and consequently of the carrying web 32. When the defective cigarette has been separated out in the way described, the actuating lever 35 and consequently the carrying web 32 return to the initial position. Accordingly, a separately movable carrying web 32 with an actuating lever 35, a pawl 38 and a control disc 41 is assigned to each magazine shaft.

The defective cigarettes 29 can be eliminated in various ways below the main pushing-out plane 22. In the exemplary embodiment shown in FIG. 3, a blast nozzle 42 is pointed towards the opposite end face of the defective cigarette 29 below the main pushing-out plane 22. The defective cigarette is consequently conveyed rearwards counter to the pushing-out direction of the intact cigarettes.

Figure 4:
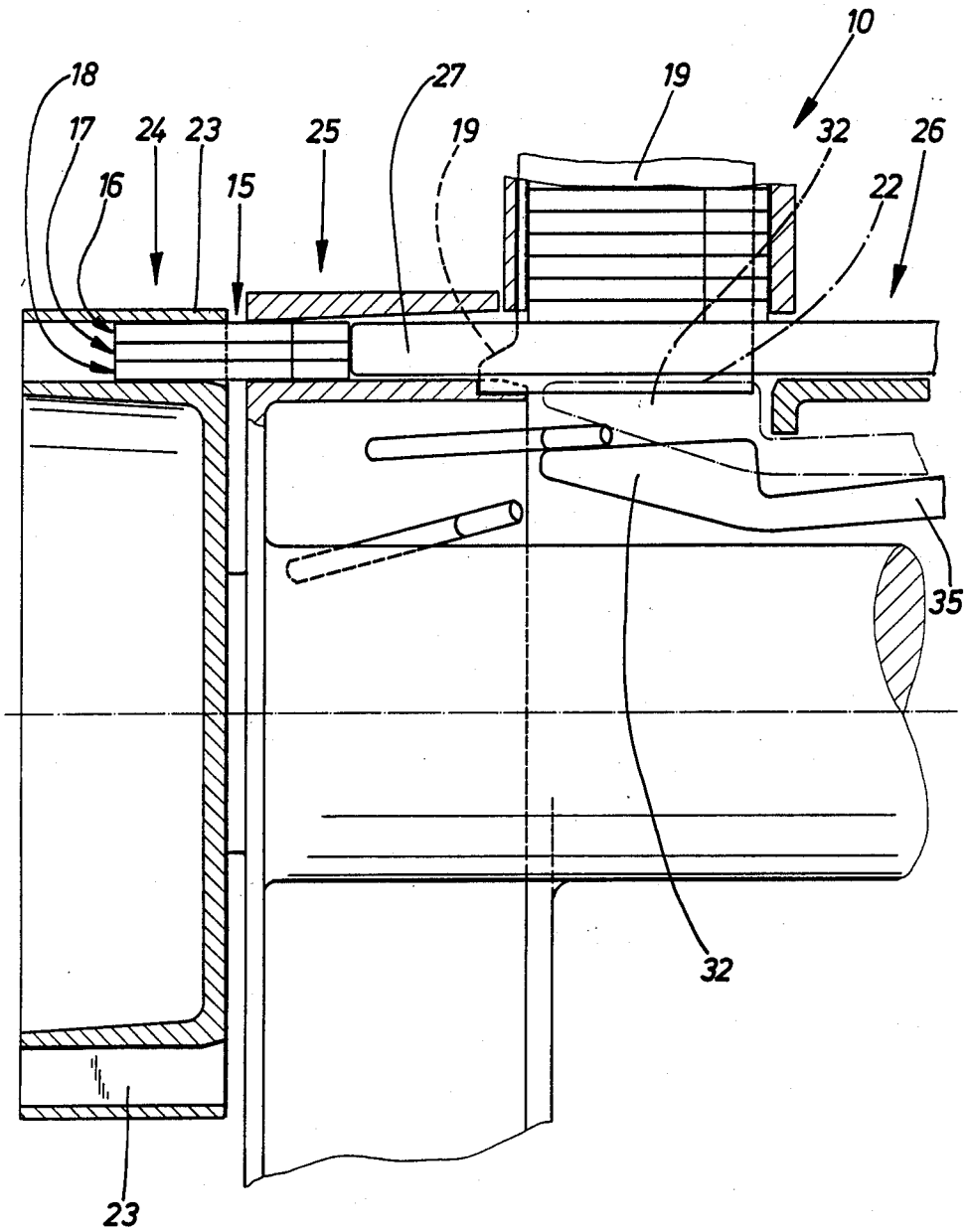
FIG. 4 shows a further detail in the bottom region of the cigarette magazine in a section corresponding to that of FIG. 3, relating to another embodiment.

In the exemplary embodiment of FIG. 4, the carrying web 32, with the defective cigarette 29 resting on it, is lowered even further, so that the defective cigarette 29 can fall down into the free space. Accordingly, there are three different positions of the carrying webs 32 here.

In the present design of the cigarette magazine, the shaft walls 19 consisting of thin sheets are extended downwards beyond the main pushing-out plane 22 and are widened. Consequently, not only are the cigarettes located in the bottom layer 18 in the main pushing out plane 22 separated laterally from one another, but also it is guaranteed that the defective cigarettes 29 assume a stable position supported laterally on a lowered carrying web 32 (see FIG. 3).

We claim:

1. Process for testing cigarettes and separating out defective cigarettes, the test being conducted in the region of magazine shafts of a cigarette magazine by a test unit which can be advanced to the ends of the cigarettes, and defective cigarettes being separated out in succession, whereas intact cigarettes are pushed out in cigarette groups at the bottom end of the magazine shafts in a main pushing-out plane, each group containing plural layers of cigarettes, said process comprising the steps of conveying defective cigarettes (29) beyond the main pushing-out plane (22) into a secohd region below the latter, and separated out the defective cigarettes in said second region.

2. Process according to claim 1, further comprising the step of separating out the defective cigarettes (29) in a plane immediately below the main pushing-out plane (22).

3. Process according to claim 2, further comprising the steps of conveying the defective cigarettes (29), in conveying stages corresponding to the diameter of at least two cigarettes, into a plane immediately above a cigarette group (15) located in the main pushing-out plane (22); and then, conveying the defective cigarettes, in a conveying stage greater than the number of layers (16, 17, 18) of the cigarette group (15) located in the main pushing-out plane (22), into the plane below the main pushing-out plane (22).

4. Process according to claim 3, wherein said number is three; and, when cigarette groups (15) with three layers (16, 17, 18) are pushed out, making the conveying stages of the defective cigarettes (29) correspond alternately to the diameter of three or four cigarettes.

5. Process according to claim 3, further comprising the step of testing the cigarettes in the region of a transverse slide (30, 31) of the magazine shafts (11*a*, 11*b*, etc., and 12*a*, 12*b*, etc.), at a distance which is upstream from the main pushing-out plane (22) and which corresponds to at least three conveying stages into the plane below the main pushing-out plane (22).

6. Apparatus for testing cigarettes and separating out defective cigarettes, the test being conducted in the region of magazine shafts of a cigarette magazine by a test unit which can be advanced to the ends of the cigarettes, in which defective cigarettes can be separated out in succession, whereas intact cigarettes can be pushed out in cigarette groups at the bottom end of the magazine shafts in a main pushing-out plane, said apparatus being characterized in that the bottom cigarettes (bottom layer 18) of the cigarette group (15) to be pushed out rest on movable cigarette carrying webs (32) which are movable up and down and which are individually movable in order to execute different conveying stages for cigarettes in the magazine shaft (lla, llb, etc., and 12*a*, 12*b*, etc.).

7. Apparatus according to claim 6, characterized in that the carrying webs (32) are movable out of an upper initial position assigned to the main pushing-out plane (22) into a position offset downwards approximately the diameter of one cigarette, in order to execute larger conveying steps and separate out defective cigarettes (29).

8. Apparatus according to claim 7, characterized in that the carrying webs (32) are arranged on one end of a two-armed actuating lever (35) which is pivotable about a pivot bearing (36), and in that the pivoting of a free lever arm (37) of said lever is controllable in reaction to defective cigarettes (29) detected during the test.

9. Apparatus according to claim 6, wherein defective cigarettes (29) are removed by blown air underneath the main pushing-out plane (22), and wherein the blown air is provided by air nozzle means (42).

* * * * *